US006852087B1

(12) United States Patent
Dainese

(10) Patent No.: US 6,852,087 B1
(45) Date of Patent: Feb. 8, 2005

(54) BACK PROTECTOR, IN PARTICULAR FOR MOTORCYCLISTS

(75) Inventor: Lino Dainese, Molvena (IT)

(73) Assignee: Dainese S.p.A., Molvena (IT)

( * ) Notice: Subject to any disclaimer, the term of this patent is extended or adjusted under 35 U.S.C. 154(b) by 0 days.

(21) Appl. No.: 09/446,691

(22) PCT Filed: Jul. 9, 1998

(86) PCT No.: PCT/EP98/04264

§ 371 (c)(1),
(2), (4) Date: Dec. 27, 1999

(87) PCT Pub. No.: WO99/04661

PCT Pub. Date: Feb. 4, 1999

(30) Foreign Application Priority Data

Jul. 24, 1997 (IT) ..... VE970036 U

(51) Int. Cl.[7] ..... A61F 13/00; A41D 13/00; A41D 9/02

(52) U.S. Cl. ..... 602/19; 2/455; 2/467; 128/846

(58) Field of Search ..... 602/19, 5, 60, 602/61, 12; 2/455, 467, 463, 464, 44, 45, 456, 459; 128/846, 870, 969

(56) References Cited

U.S. PATENT DOCUMENTS

| | | | | | |
|---|---|---|---|---|---|
| 4,481,941 | A | * | 11/1984 | Rolfes | 602/24 |
| 5,140,995 | A | * | 8/1992 | Uhl | 2/455 |
| 5,328,447 | A | | 7/1994 | Kapounek et al. | |
| 5,400,801 | A | * | 3/1995 | Archer, III | 2/455 |
| 5,620,412 | A | * | 4/1997 | Modglin | 602/24 |
| 5,768,717 | A | * | 6/1998 | Le Sueur | 2/467 |
| 5,840,051 | A | * | 11/1998 | Towsley | 602/19 |
| 5,915,543 | A | * | 6/1999 | Julin | 2/467 |

FOREIGN PATENT DOCUMENTS

| | | |
|---|---|---|
| DE | U19115839 | 5/1992 |
| DE | A119545299 | 6/1997 |
| EP | A10134727 | 3/1985 |
| EP | A10212206 | 3/1987 |

* cited by examiner

*Primary Examiner*—Kim M. Lewis
(74) *Attorney, Agent, or Firm*—Birch, Stewart, Kolasch & Birch, LLP

(57) ABSTRACT

A back protector, in particular for motorcyclists, including two vertically aligned supports provided with elements for fixing them to a motorcyclist's body, each of the supports containing a plurality of substantially rigid elements fixed thereto, the lower support being hinged to the upper support by a pin.

15 Claims, 3 Drawing Sheets

FIG. 2
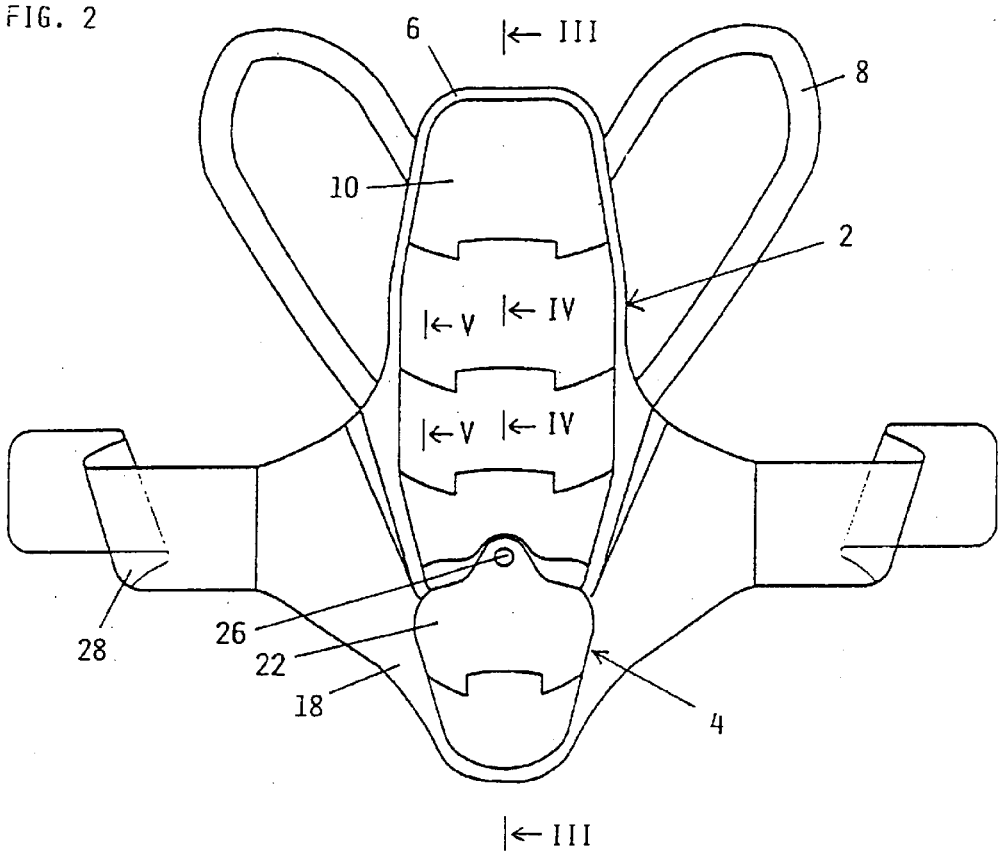
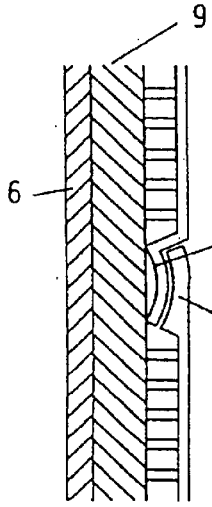
FIG. 4
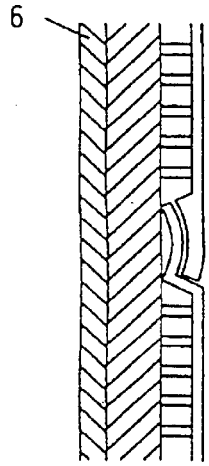
FIG. 5

BACK PROTECTOR, IN PARTICULAR FOR MOTORCYCLISTS

This application is the national phase under 35 U.S.C. § 371 of PCT International Application No. PCT/EP98/04264 which has an International filing date of Jul. 9, 1998, which designated the United States of America.

FIELD OF THE INVENTION

The present invention relates to a back protector, in particular for motorcyclists.

DESCRIPTION OF THE PRIOR ART

Protectors for body parts are known. In certain cases they consist of substantially rigid paddings and/or shields which in the case of a fall absorb the impact, to protect those parts of the motorcyclist's body most exposed to injury and fracture (shoulders, elbows, knees, etc.).

These elements are applied to the motorcyclist's suit and generally comprise an outer shell constructed of substantially rigid plastic, an inner layer able to absorb the impact energy, and a layer of soft material provided with means for fixing it to the suit.

With regard to back protection, belts are known in the form of a band provided at its rear with a plurality of substantially rigid elements, each consisting of a plate arranged vertically and aligned with a partial overlap between each plate and the adjacent plate.

In the motorcyclist field the objective is to achieve maximum protection of that part of the spinal column comprising the spinal cord, because of the seriousness of possible injury in that anatomical region. As to the vertebrae associated with the spinal cord which includes the thoracic vertebrae (as far as the twelfth) and the first two lumbar vertebrae, i.e., a position which for an individual of average height extends a few centimeters above the waistline, the belt provides protection in this anatomical region.

However, as the protective action preferably also extends to the remaining portion of the spinal column, i.e., to the remaining lumbar vertebrae, such back protectors extend below the waistline to also cover part of the glutei.

However, this protection system has the drawback that the rigidity of the structure opposes lateral flexure of the trunk and forward and rearward bending, thus interfering with the movements required during driving.

EP-A-0 212 206 discloses a plurality of plates which are placed in overlapping relationship in an elongated array extending along the spinal column or other body area to be protected. The plates are pivotally interconnected by joints which allow relative rotation to a limited extent between the plates and limited longitudinal movement between the plates so that the armor structure conforms to body changes during normal movements. Over extension is prevented by abutment of the plates against each other, limiting harmful movement of the protected body portions.

SUMMARY OF THE INVENTION

An object of the present invention is to eliminate these drawbacks by providing a back protector for the spinal cord and glutei of the spinal column which allows free lateral flexure of the trunk and forward bending but only moderate rearward bending, while always performing its protective function.

This and further objects which will be apparent from the ensuing description are attained according to the present invention by a back protector, in particular for motorcyclists, comprising two vertically aligned supports provided with means for their being fixed to a motorcyclist's body, each of said supports carrying a plurality of substantially rigid elements fixed thereto, said lower support being hinged to said upper support by a pin.

BRIEF DESCRIPTION OF THE DRAWINGS

This invention is described in detail hereinafter with reference to the accompanying drawings, in which:

FIG. 2 is a front view thereof, FIG. 4 is an enlarged cross-sectional view taken along line IV—IV of FIG. 2, and FIG. 5 is an enlarged cross-sectional view taken along line V—V of FIG. 2.

DESCRIPTION OF PREFERRED EMBODIMENTS

Figure 1:
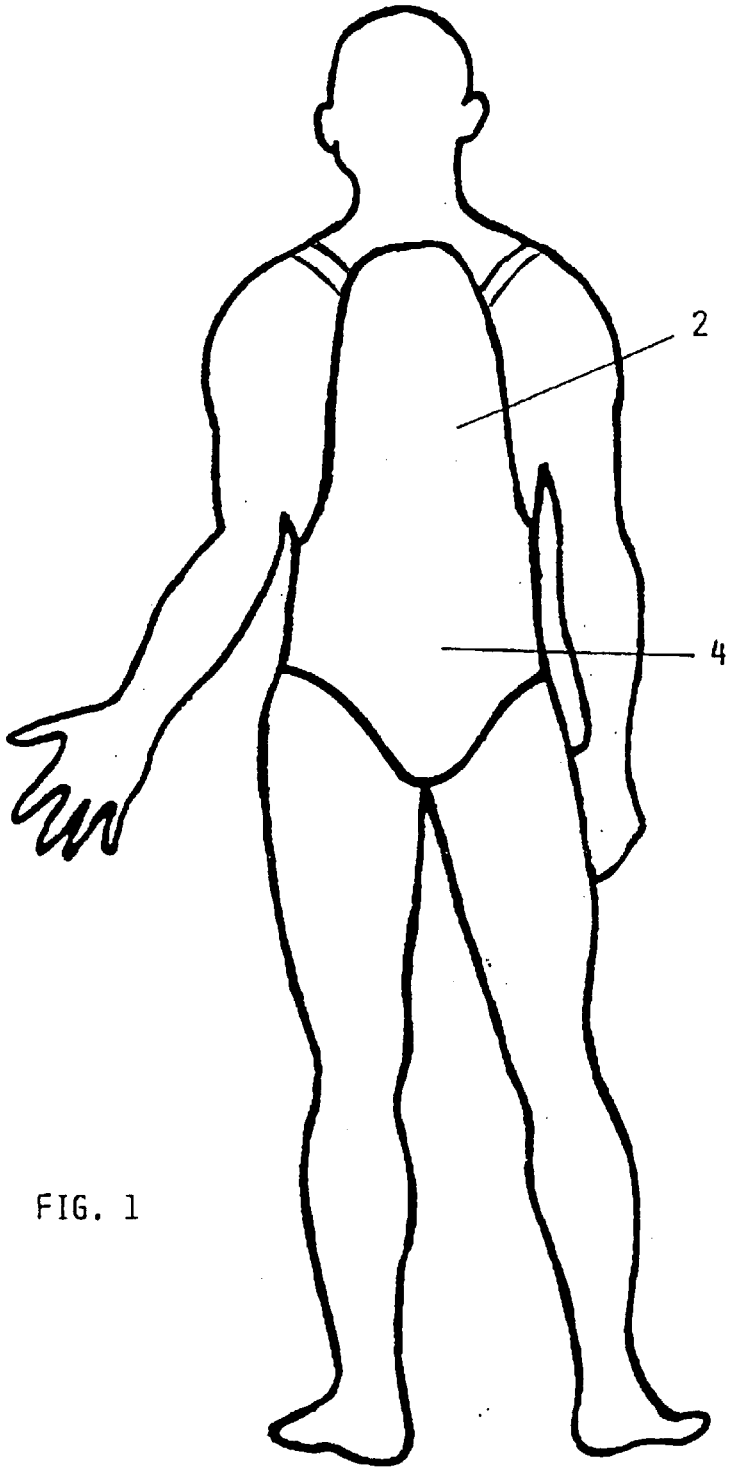
FIG. 1 is a schematic view of a protector according to the present invention.
Figure 3:
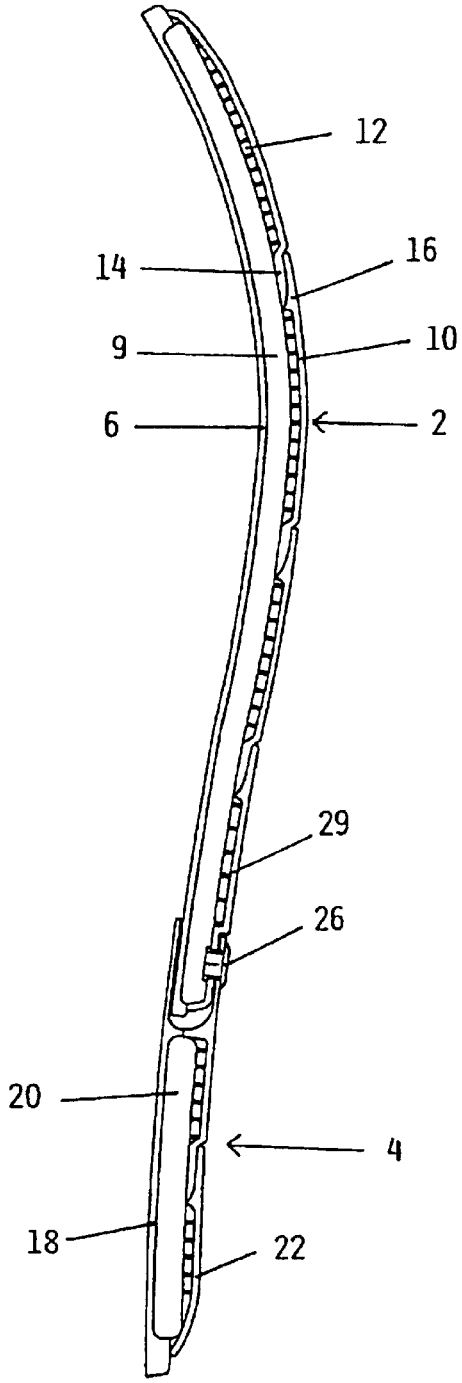
FIG. 3 is an enlarged cross-sectional view taken along line III—III of FIG. 2.

As can be seen from the figures, the back protector according to the present invention comprises a substantially elliptical upper element 2 extending through a length such as to cover the thoracic vertebrae and the first two lumbar vertebrae, and an underlying element 4 of a length sufficient to cover the remaining lumbar vertebrae and part of the glutei.

In particular, the element 2 consists of a layer of soft expanded material 6 provided with braces 8, an intermediate layer 9 of soft material able to absorb the impact energy, and a plurality of superimposed plates 10 (four in the illustrated example), the inner surface of each plate comprising a plurality of ribs 12 which mutually intersect to form a honeycomb structure and define a grid of ribs.

Each plate 10 has a depressed lower end portion 14 on which the upper end 16 of the underlying plate is superimposed.

The lower element 4 comprises substantially an inner layer 18 of expanded soft material to which there are applied a soft material layer 20 to absorb the impact and two plates 22. The upper plate of the element is hinged on an end pin 26 to the lower end of the lower plate 29 of the upper element 2.

The type of connection between two adjacent plates both of the upper element 2 and of the lower element 4 is shown in FIGS. 4 and 5. It is made by hinge elements which enable the plates to rotate relative to each other without fissures or cavities being created between one plate and the next.

The expanded material layer 18 is fixed at both ends to a support belt 28 which is secured to the motorcyclist's waist.

The plate structure allows free forward bending movement and follows the back profile in the various positions assumed by the driver.

From the foregoing it is apparent that the protection element of the present invention not only provides total protection to the vertebrae of the spinal cord and of the gluteus part, but also, by virtue of the hinging of the two parts and of the hinging between adjacent plates, enables the bust to flex laterally and to bend forward and backward.

Braces and belts have been used in the illustrated embodiment, however, the present invention also allows for the use of support means in the form of buttons, zip fasteners and any element enabling the back protector to be applied to a jacket, a suit or any other article of clothing.

I claim:

1. A back protector which comprises an upper support and a lower support, said upper and lower supports being adapted to conform to upper and lower regions of the back of a user, said upper support being substantially vertically aligned with said lower support, said upper support and lower support being provided with respective means for fixing them to the back of the user, each of said supports carrying a plurality of substantially rigid elements fixed thereto, said lower support being directly hinged to said upper support on a single pin.

2. The back protector as claimed in claim 1, wherein said rigid elements comprise plates having a strengthening grid of ribs provided at one surface thereof.

3. The back protector as claimed in claim 2, wherein the plates of each support are connected together mechanically by hinge elements.

4. The back protector as claimed in claim 1, wherein said upper support contains an intermediate layer of material which provides impact absorption.

5. The back protector as claimed in claim 1, wherein said lower support contains an intermediate layer of material which provides impact absorption.

6. The back protector as claimed in claim 1, wherein said upper support is provided with braces.

7. The back protector as claimed in claim 1, wherein said lower support is provided with a belt.

8. The back protector as claimed in claim 1, wherein the lower support is hinged to the upper support by a pin.

9. The back protector as claimed in claim 2, wherein the grid of ribs mutually intersect to form a honeycomb structure.

10. The back protector of claim 1 wherein the upper and lower supports are adapted to conform to a human spinal column.

11. The back protector of claim 10, wherein the lower support is hinged to the upper support to move relative to the movement of the human spinal column.

12. The back protector of claim 1, wherein at least one of the upper and lower supports comprises a plurality of adjacent plates which are hinged together.

13. The back protector of claim 11, wherein the hinge of the lower support to the upper support enables the spinal column to flex laterally and in the anterior and posterior directions.

14. A back protector comprising an upper support and a lower support, said upper support being substantially vertically aligned with said lower support, each of said supports including an anterior inner layer made of a soft expanded material, an intermediate layer of soft material and an outer layer comprising a plurality of interconnecting plates, the inner surface of each plate, which faces the intermediate layer being provided with a plurality of ribs fixed thereto, said lower support being directly hinged to said upper support on a single pin, and means for securing the back protector to the body of a user.

15. The back protector of claim 14, wherein the plurality of interconnecting plates overlap and are flexibly connected with respect to each other.

* * * * *